US005921081A

United States Patent [19]

Kim

[11] Patent Number: 5,921,081

[45] Date of Patent: Jul. 13, 1999

[54] MOTOR VEHICLE MUFFLER

[75] Inventor: Kyung-Tae Kim, Kyungki-do, Rep. of Korea

[73] Assignee: Hyundai Motor Company, Seoul, Rep. of Korea

[21] Appl. No.: 08/988,238

[22] Filed: Dec. 10, 1997

[30] Foreign Application Priority Data

Dec. 19, 1996 [KR] Rep. of Korea ..... 96-67756

[51] Int. Cl.[6] ..... F01N 1/16

[52] U.S. Cl. ..... 60/324; 181/241; 181/278

[58] Field of Search ..... 60/312, 324; 181/241, 181/271, 277, 278

[56] References Cited

U.S. PATENT DOCUMENTS

| | | | |
|---|---|---|---|
| 2,214,894 | 9/1940 | Wilson | 181/241 X |
| 4,903,486 | 2/1990 | Finkle | 60/324 |
| 5,475,189 | 12/1995 | Field et al. | 181/241 |

*Primary Examiner*—Tony M. Argenbright

[57] ABSTRACT

A motor vehicle muffler mounted with a plurality of baffles, the muffler comprising a variable control unit constructed such that at least one baffle in the muffler is moved to vary volumes of chambers according to a depression of an accelerator pedal, to obtain an optimum noise attenuation effect and to increase exhaust efficiency.

5 Claims, 3 Drawing Sheets

MOTOR VEHICLE MUFFLER

BACKGROUND OF THE INVENTION

1. Field of the Invention

The present invention relates to a muffler, and more particularly to a muffler affixed to an exhaust apparatus of a motor vehicle for noise attenuation.

2. Description of Related Art

Generally, an exhaust apparatus is equipped to prevent an exploding sound generated when combustion gas of high temperature and high pressure generated from an engine explosion is emitted into the air and to prevent emission of harmful gases.

The aforementioned exhaust apparatus includes, as illustrated in FIG. 4, an exhaust pipe 51, servo and main muffler 52 and 53, and a catalytic converter 54.

In other words, pressure and vibration are attenuated when the combustion gas emitted through an exhaust port of an engine is exhausted outside via the catalytic converter 54 and the servo and main mufflers 52 and 53.

The main muffler 53 thus described includes, as illustrated in FIG. 5, a housing 55, first, second and third baffles 60, 61 and 62, a first pipe 63, a second pipe 64 and a third pipe 65, where the second baffle 61 is formed with an air hole 66.

When the combustion gas of high pressure and high temperature is input into the housing 55 via the exhaust pipe 51 and sequentially into first, second, third and fourth chamber 56, 57, 58 and 59, the gas is abruptly expanded to reduce its temperature and pressure.

Specifically, when the combustion gas is infused into the respective chambers 56, 57, 58 and 59, pulsation generated from the engine is reduced by resonance, whereby the pressure and the temperature are dropped to attenuate the exhaust noise during exhaustion thereof.

The pulsation reduction by way of resonance is appropriately established by volumes of respective chambers 56, 57, 58 and 59, and lengths and diameters of the exhaust pipe 51 and pipes.

However, there is a problem in that the aforementioned noise attenuation effect is sharply reduced when exhaustion pressure is outside of a predetermined exhaust pressure range because the exhaustion pressure changes according to revolution per minute (RPM) of the engine.

In other words, the above described conventional muffler is designed according to an average exhaust pressure at high and low speeds, so that, when a running speed of a vehicle is outside of escapes the average exhaust pressure, the silencer attenuation effect is decreased, thereby increasing the noise of the running vehicle.

SUMMARY OF THE INVENTION

Accordingly, the present invention is presented to solve the aforementioned problem, and it is an object of the present invention to provide a motor vehicle muffler adapted to increase or decrease a chamber volume according to the RPM of the vehicle engine to cause a noise attenuation to be optimally maintained according to a vehicle speed and to thereby minimize noise generated from the running vehicle.

In accordance with the object of the present invention, there is a motor vehicle muffler includes with a plurality of baffles, the muffler comprising a variable mechanism such that baffles in the muffler are moved to vary volumes of therebetween according to an amount that the accelerator pedal is depressed.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
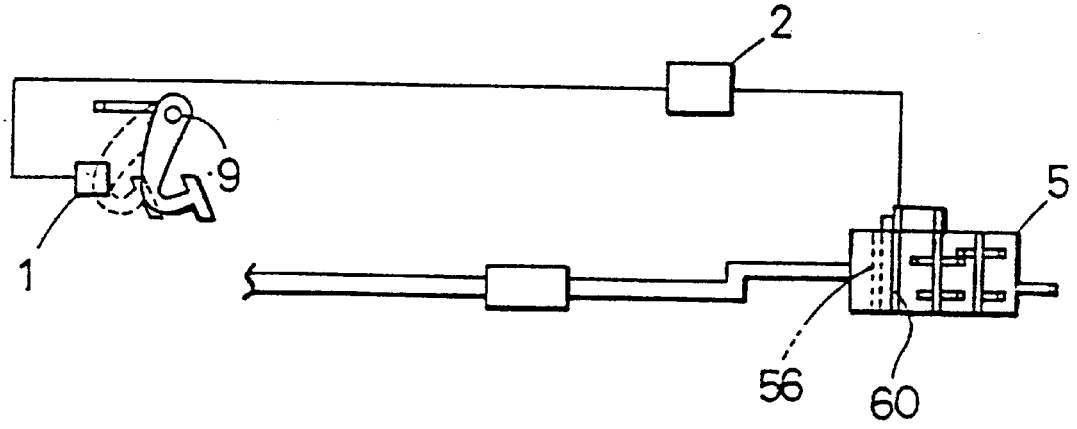
FIG. 1 is a schematic diagram for illustrating a motor vehicle muffler according to the present invention.

FIG. 1 is a schematic diagram for illustrating a motor vehicle muffler according to the present invention, where a housing 55 includes a variable mechanism constructed to move baffles in the housing according to a depression amount of an accelerator pedal (P) to vary thereby volumes of chambers defined by the baffles.

The variable mechanism includes a pedal pressure sensor 1 disposed underneath a rear surface of the accelerator pedal (P) for detecting an amount that pedal P is depressed, an electronic control unit (ECU 2) connected to the pressure sensor 1 for receiving sensed pedal depression information, and a driving mechanism for controlling the ECU according to the sensed information from the ECU, the driving mechanism being affixed to a first baffle 60 at the housing 55 to move the first baffle 60.

In other words, when the ECU 2 checks the depression amount of the accelerator pedal (P) to appropriately actuate the driving mechanism, the first baffle 60 affixed thereto is moved to vary volume of a first chamber 56 within housing 55.

At this location, it should be apparent that the variable mechanism is not limited to being associated with the first baffle 60 but can be mounted at any respective baffle of the muffler for accomplishment of the same or comparable effect.

Figure 2:
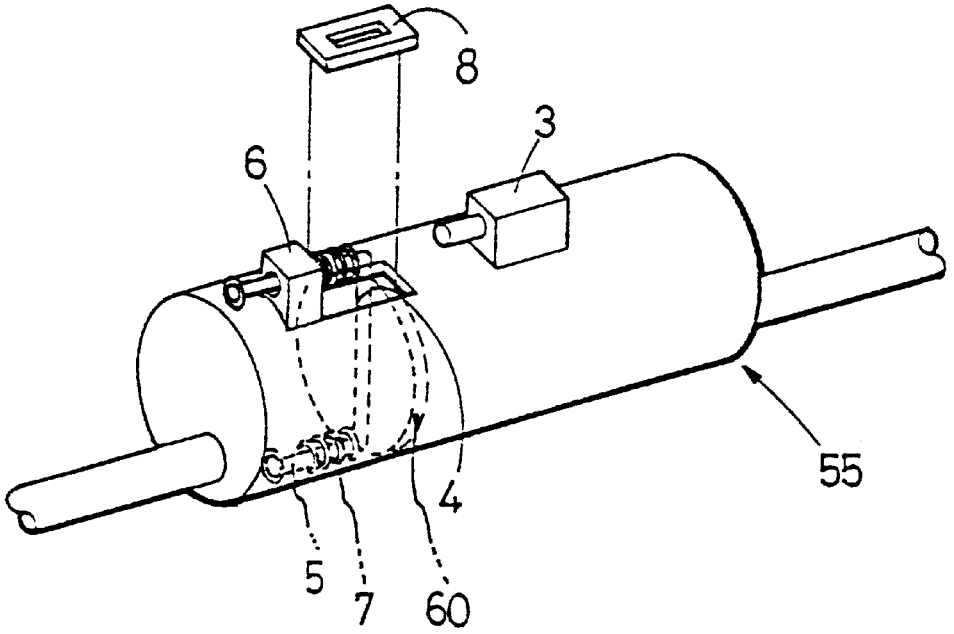
FIG. 2 is an partial sectional view of FIG. 1.
Figure 3:
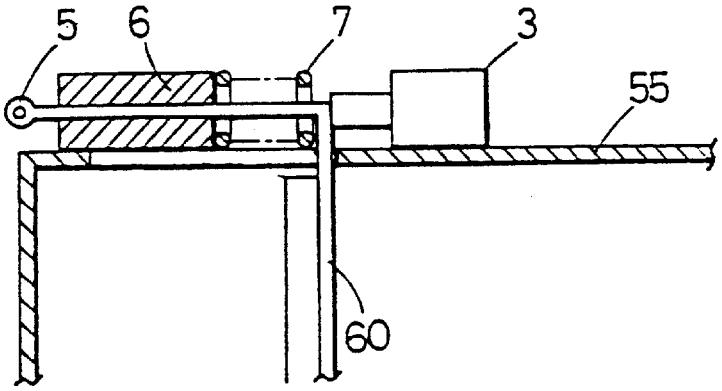
FIG. 3 is a partially enlarged sectional view for illustrating a driving means in FIG. 1.
Figure 4:
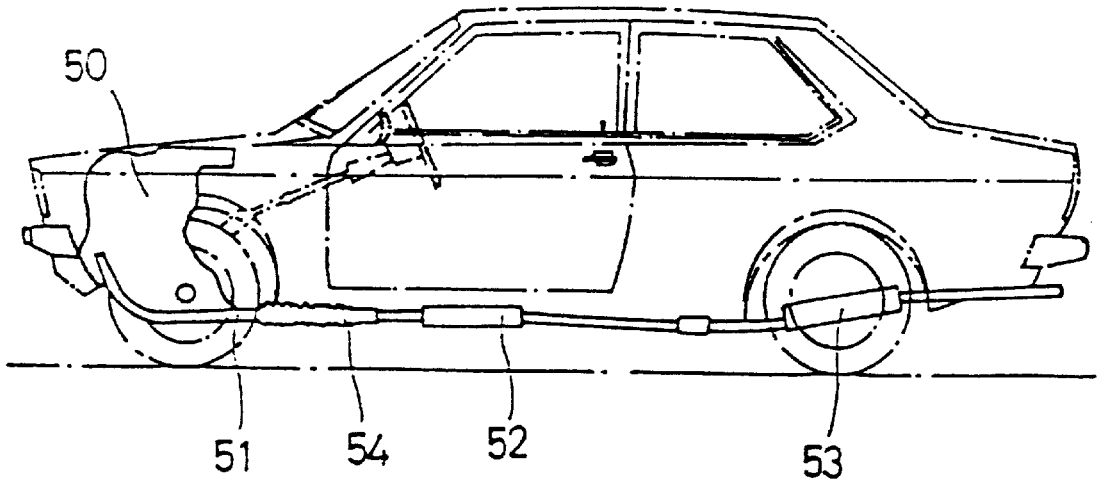
FIG. 4 (PRIOR ART)
FIG. 4 is a schematic diagram for illustrating a conventional exhaust apparatus in a motor vehicle.
Figure 5:
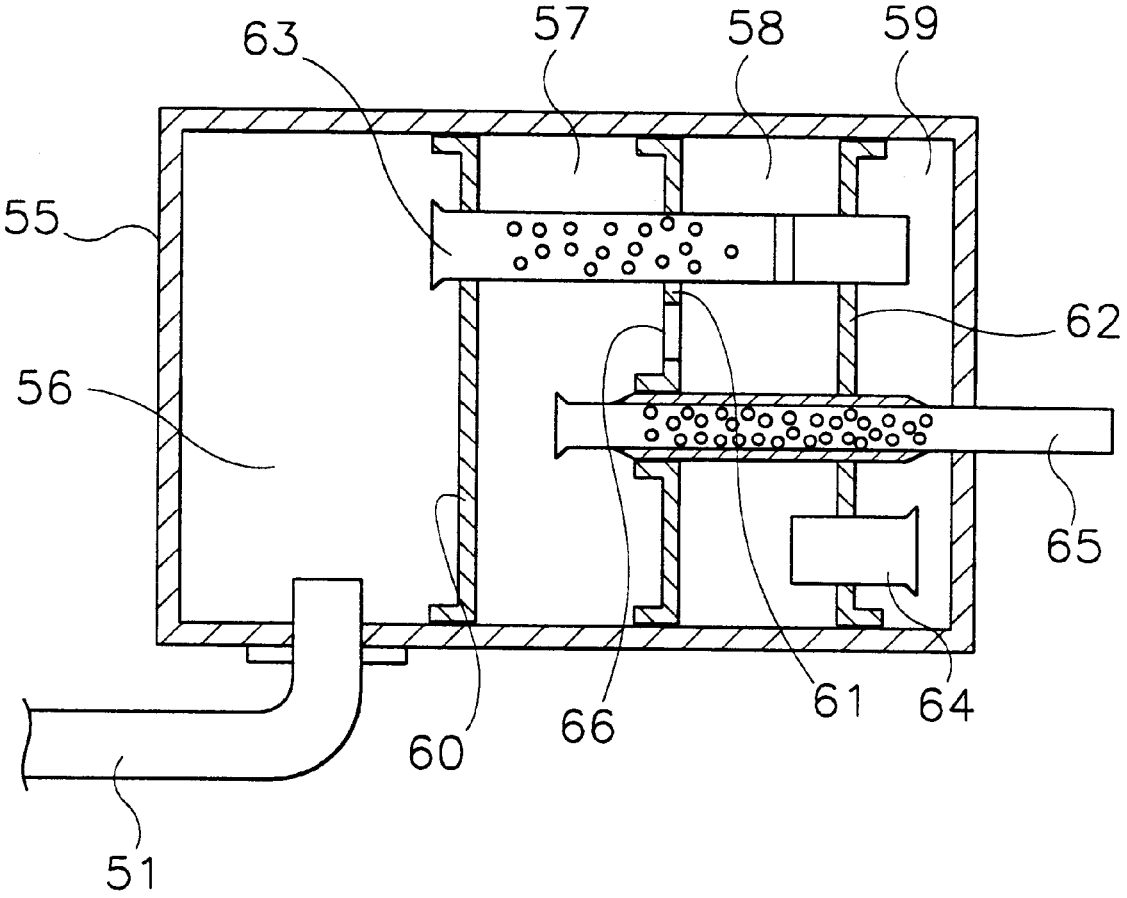
FIG. 5 (PRIOR ART)
FIG. 5 is a sectional view for illustrating a the conventional muffler in FIG. 4.

The driving mechanism includes, as illustrated in FIGS. 2 and 3, a solenoid 3 connected to the ECU 2 and affixed to the housing 55, a hole 4 formed at the housing 55 at a front side of the solenoid 3, a slider 5 affixed to the first baffle 60 so as to be inserted into the hole 4 and protruded onto an upper surface of the housing 55, a guide 6 disposed at one side of the housing 55 to allow the slider 5 to penetrate therethrough, and a spring 7 disposed between the guide 6 and the slider 5 to apply an extension force.

It should be noted that a rubber sealing material 8 is held in place between the hole 4 and the slider 5 for airtight sealing of the muffler at an interior thereof.

Now, operational effect of the present invention will be described.

When a driver depresses accelerator pedal (P) in order to accelerate the vehicle is running, the pressure sensor I serves to detect the depression, information of which is transmitted to the ECU 2.

When the signal is transmitted to the ECU 2, the current applied to the solenoid 3 is decreased by the ECU 2. When the current applied to the solenoid 3 is retracted, so that a plunger of the solenoid 3 is decreased, a plunger at the solenoid is moved to the right on the drawings.

When the plunger of the solenoid 3 moves, the slider moves because of the spring 7 disposed opposite the solenoid 3.

When the slider 5 is pushed aside by the resilient force of the spring 7, the slider 5 is moved along the moving hole at the housing 55.

In other words, when the first baffle 60 affixed to the slider 5 is moved to the right on the drawing, volume of the first chamber 56 in increased, thereby appropriately coping with the increased exhaustion pressure.

Under this circumstance, when his the driver lifts the foot from the accelerator pedal (P) to decrease the speed of the vehicle, the pressure sensor 1 detects deceleration of the vehicle and transmits this to the ECU 2. The ECU 2 in turn increases the current applied to the solenoid 3 to push the slider 5 to the left on the drawing by way of the plunger.

When the slider 5 is pushed, the first baffle 60 is moved to the left, thereby decreasing the volume of the first chamber 1 so as to provide a noise attenuation appropriate for low speed running.

In other words, the volume of the first chamber 56, that is, resonant state is controlled according to the amount that of the accelerator is depressed, to optimize the noise attenuation effect according to respective running conditions.

As apparent from the foregoing, there is an advantage in the motor vehicle muffler according to the present invention, in that an inner chamber volume of a muffler can be changed according to running conditions of a vehicle to thereby obtain an optimum noise attenuation effect.

What is claimed is:

1. A muffler for a motor vehicle comprising:

a housing;

a plurality of baffles transversely disposed within said housing so as to define a plurality of chambers therein, wherein at least one of said baffles is movably mounted within said housing so as to vary the volume of said chambers on either side thereof; and a control mechanism constructed and arranged to move said at least one movably mounted baffle in accordance with a running speed of a motor of the motor vehicle, said control mechanism comprising:

a sensor constructed and arranged to detect a running speed of the motor and transmit a signal corresponding thereto;

an electronic control unit constructed and arranged to receive said signal from said sensor and to transmit a control signal corresponding thereto; and a driving mechanism connected to said at least one movably mounted baffle and constructed and arranged to move said at least one movably mounted baffle along said housing in accordance with said control signal transmitted by said electronic control unit.

2. The muffler as claimed in claim 1, wherein said sensor is a pressure sensor constructed and arranged to detect an extent to which an accelerator pedal of the motor vehicle is depressed.

3. The muffler as claimed in claim 1, wherein said driving mechanism comprises:

a guide rail extending orthogonally from a plane of said at least one movably mounted baffle and being connected thereto;

a guide post having an opening therethrough through which said guide rail passes, whereby movement of said at least one movably mounted baffle is guided by said guide rail passing through said guide post;

a resilient spring member located between said guide post and said at least one movably mounted baffle so as to resiliently bias said at least one movably mounted baffle away from said guide post;

a solenoid operatively connected to said electronic control unit and located on an opposite side of said at least one movably mounted baffle from said guide post, said solenoid including a plunger member constructed and arranged so as to selectively extend and force said at least one movably mounted baffle against said resilient spring member in correspondence with said control signal received by said electronic control unit, thereby moving said at least one movably mounted baffle.

4. The muffler according to claim 3, wherein said housing includes a hole formed in said housing, wherein said guide post and said solenoid are provided on opposite sides of said hole, and wherein a portion of said guide rail extends through said hole so as to be passed through said opening of said guide post.

5. The muffler according to claim 4, including a seal member for sealing a space between a periphery of said hole formed in said housing and said portion of said guide post extending through said hole.

* * * * *